US009109805B2

(12) United States Patent
Bach

(10) Patent No.: US 9,109,805 B2
(45) Date of Patent: Aug. 18, 2015

(54) RANGE HOOD WITH TEMPERATURE DETECTION AND NOTIFICATION

(75) Inventor: James Carter Bach, Seymour, IN (US)

(73) Assignee: General Electric Company, Schenectady, NY (US)

( * ) Notice: Subject to any disclaimer, the term of this patent is extended or adjusted under 35 U.S.C. 154(b) by 365 days.

(21) Appl. No.: 13/353,533

(22) Filed: Jan. 19, 2012

(65) Prior Publication Data

US 2013/0187781 A1 Jul. 25, 2013

(51) Int. Cl.
*G08B 17/00* (2006.01)
*F24C 15/20* (2006.01)

(52) U.S. Cl.
CPC ..... *F24C 15/2021* (2013.01); *F24C 15/2064* (2013.01)

(58) Field of Classification Search
USPC ..... 340/584; 126/299 R, 42; 99/357, 99; 362/493, 506; 356/51
See application file for complete search history.

(56) References Cited

U.S. PATENT DOCUMENTS 7,699,051 B2 4/2010 Gagas et al.
2007/0053195 A1* 3/2007 Alberti ..... 362/494
2007/0193753 A1 8/2007 Adiga et al.
2008/0053426 A1* 3/2008 Erdmann ..... 126/42
2008/0141996 A1* 6/2008 Erdmann ..... 126/299 D
2009/0085754 A1* 4/2009 Myllymaki ..... 340/584
2009/0272372 A1 11/2009 Griffin et al.
2011/0088679 A1* 4/2011 Lerner ..... 126/42
2011/0134413 A1* 6/2011 Has et al. ..... 356/51
2011/0284091 A1* 11/2011 Livchak et al. ..... 137/2
2012/0320345 A1* 12/2012 Kleinert et al. ..... 353/98

FOREIGN PATENT DOCUMENTS

WO WO 2007082993 7/2007
WO WO 2009134481 11/2009

* cited by examiner

*Primary Examiner* — Benjamin C Lee
*Assistant Examiner* — Chico A Foxx
(74) *Attorney, Agent, or Firm* — Dorioty & Manning, P.A.

(57) ABSTRACT

A range hood with features for monitoring the temperature of a cook top located below it is provided. In one example, the range hood includes one or more temperature sensors positioned over the cook top for measuring temperature of the heating elements below. If the measured temperatures(s) exceeds one or more predetermined temperature levels, either with or without a time delay, a notification and/or other remedial response is provided to a user of the appliance. The notification can be, for example, a visual warning projected onto the cook top and/or an audible alarm. Different warnings can be provided based on different temperature levels as measured by the temperature sensors.

17 Claims, 2 Drawing Sheets

RANGE HOOD WITH TEMPERATURE DETECTION AND NOTIFICATION

FIELD OF THE INVENTION

The subject matter of the present invention relates generally to a range hood that can monitor the temperature of a cook top located beneath it and provide notification and or remedial response(s) based on such temperature monitoring.

BACKGROUND OF THE INVENTION

Conventionally, cook top appliances have been largely dependent upon a user monitoring the cook top during use in order to prevent undesirable temperature levels and/or prolonged periods of heating such as e.g., when a heating element is left on after cooking a meal. During use, it may be visibly apparent that a particular heating element is activated. For example, with a gas burner, the user may be able to see the flame. With an electric resistance (aka coil) or electric radiant cook top, the heating element may provide an orange or red glow indicating a high temperature.

There may be times, however, when there is no visual indication that a heating element is activated or at high temperature. By way of example, some heating elements do not necessarily emit light or otherwise indicate their energized status at all times during operation, particularly at low power levels (such as "Simmer" or "Warm"). Also, even if it is visually apparent that a heating element is activated, visual inspection may not reveal the actual temperature level such that the user may not appreciate that an undesirable temperature has been reached if the user is not otherwise carefully monitoring temperature. For example, an undesirable temperature may include one at which food can be burned, the cook top appliance can be damaged, contact with the user is undesirable, a cooking oil could be ignited, and others. Alternatively, the temperature level of a heating element may be undesirable simply because the heating element has been left on for a prolonged period of time during which the user is not actually using the cook top. Similarly, even after the heating element is turned off residual heat in the cook top surface (or in the case of a gas cook top, the metal support grate above the burner) can remain hot for a considerable period of time.

In the case of electric radiant and induction cook tops the heating element generally contains a temperature-sensitive switch that controls the illumination of a visual indicator somewhere on the cook top surface, typically near the control knobs or touch pad. However, this indicator is generally small and hard to perceive over wide viewing angles, and generally is not positioned where the cook top is actually "hot." In the case of electric resistance (aka coil) and gas cook tops no such temperature sensitive switch is easily implementable, therefore direct monitoring of the heating element temperature is not performed, and, generally, no visual indicator is provided.

Several challenges are created for the design of features for monitoring the temperature of a cook top and providing notifications and/or remedial responses based on such temperature measurement. For example, cook top appliances can include a variety of configurations for the heating elements located on the cook top surface. The number of heating elements or positions available for heating on the cook top can include e.g., four, six, or more depending upon the intended application and preferences of the buyer. These heating elements can also vary in size and location along the surface of the cook top. Further, the types of heating elements available include, for example, gas burner, electric resistance (e.g., hot coil), electric radiant, and induction. As such, when a cook top and range hood are not purchased by a consumer as a complementary pair, challenges are present in providing a range hood that is equipped with temperature measuring features that will work with the wide variety of cook top configurations and types including differences in the number of heating elements. Additionally, the range hood cannot necessarily rely on communication with the cook top appliance since the cook top may not be equipped for such communication and/or may not e.g., include any temperature monitoring features.

Accordingly, a range hood with features for detecting temperatures on a variety of cook top types and configurations would be useful. Such a range hood that can detect the temperature conditions on a cook top and also provide notification to the user and/or undertake other remedial responses if temperature conditions exceed one or more predetermined levels would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a range hood with a temperature monitoring system for a cook top. The cook top has at least one heating element positioned about the cook top surface. The range hood includes at least one temperature sensor positioned above the cook top and configured for detecting the temperature of the at least one heating element of the cook top, a cooking utensil on the heating element, a food in the utensil on the cook top, or a combination thereof. The range hood also includes one or more warning devices configured for providing a first notification to a user of the appliance if the temperature sensor detects a temperature over a first predetermined temperature level, $T_{L1}$.

In another exemplary aspect of the present invention, a method for monitoring the temperature of a cook top is provided. The cook top has at least one heating element. The method includes the steps of sensing the temperature of the heating element, a cooking utensil on the heating element, a food in the utensil, or a combination thereof determining whether the temperature measured in said step of sensing exceeds a predetermined level, and, if so, then providing a warning to a user of the cook top indicative of the temperature exceeding the predetermined level.

In another exemplary aspect of the present invention, a method for monitoring the temperature of a cook top is provided. The cook top has at least one heating element. The method includes the steps of using a temperature sensor positioned above the cook top to determine the temperature of the heating element, a cooking utensil on the heating element, a food in the utensil, or a combination thereof determining whether the temperature measured in said step of sensing exceeds a first predetermined level $T_{L1}$, and, if so, then providing a warning to a user of the cook top indicative of the temperature exceeding the first predetermined level $T_{L1}$.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
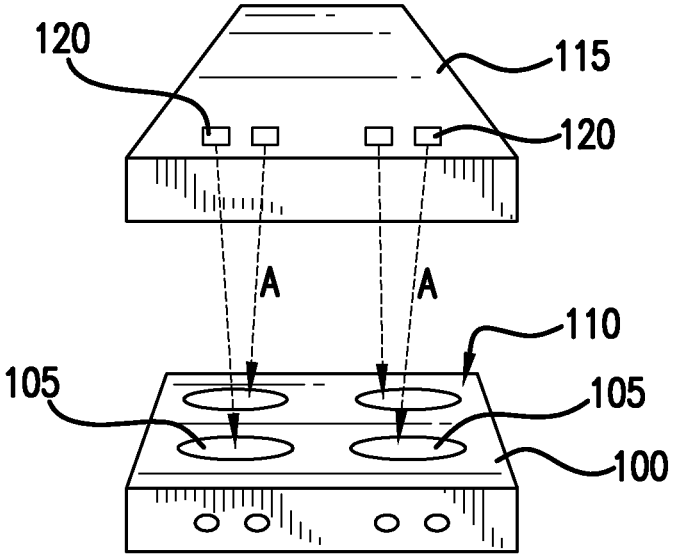
FIG. 1 is an illustration of an exemplary embodiment of the present invention using an array of temperature sensors wherein each temperature sensor is dedicated to sensing the temperature of a particular heating element therebelow.

The present invention provides a range hood with one or more temperature sensors for monitoring the temperature of a cook top positioned below it and, if the temperature on (or in the vicinity of) the cook top surface exceeds one or more predetermined temperature levels, undertake a notification to the user and/or other remedial responses. Various embodiments of the present invention can operate with a variety of cook top configurations. The range hood can be configured to provide different notifications depending upon the temperature levels measured by one or more temperature sensors. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an illustration of an exemplary embodiment of a range hood 115 with features for temperature monitoring of a cook top 100. As shown, multiple heating elements 105 are positioned about the surface 110 of cook top 100. Heating elements 105 may be constructed as, for example, gas burners, electric resistance (e.g., hot coil), electric radiant, and induction. While shown in FIG. 1 as being of equal size and positioned symmetrically about surface 110, it should be understood that the present invention may be used with heating elements of various sizes positioned as desired about the surface 110 of cook top 100. The heating elements 105 may include grates or other supports positioned over the heating elements 105. Also, heating elements 105 may be configured for use with e.g., a pot or pan, or can be constructed as e.g., a grill or griddle. Heating elements 105 may be any shape (e.g. round, oval, square, rectangular, etc.).

Range hood 115 is positioned over cook top 100. Range hood 115 typically includes one or more ventilation fans to circulate air or remove heat and fumes. Hood 115 may also include one or more lamps to illuminate the surface 110 of cook top 100. Additional features such as filters or timers may also be included. The shape and configuration of range hood 115 is not limited to that shown in the figures—it being understood that others may be used as well (square, rectangular, round, etc.). Similarly, the range hood 115 might be mounted on the wall immediately behind the cook top appliance, or suspended from the ceiling or cabinetry above the cook top appliance.

For this exemplary embodiment, range hood 115 also includes multiple temperature sensors 120. Temperature sensors 120 are positioned under range hood 115 and, for this exemplary embodiment, each sensor 120 is located approximately over a respective heating element 105. As illustrated using arrows A, each sensor 120 is also configured for detecting temperatures associated with a respective heating element 105 and providing such information to a processor or other control device configured within range hood 115 as further discussed below. As used herein, detecting the temperature of a heat source using a temperature sensor includes detecting the temperature of the actual heating device and can also include detecting the temperature of a grate or other utensil support immediately above or adjacent to the heat source. By way of example, temperature sensor 120 may be constructed from an infrared (IR) sensor capable of "seeing" a particular location or an area on surface 110. More particularly, temperature sensor 120 may be configured to sense the temperature of e.g., a location on the surface of the heating element 105 such as a burner grate or an electric coil.

Because different models of cook tops have heating elements 105 located in varying positions on the cook top surface 110, temperature sensors 120 can be implemented mechanically such that, during installation of the range hood, sensor 120 can be aimed or directed e.g., towards the center of the heating elements 105. By way of example only, in one potential implementation, sensors 120 can be mounted similar to the readily positionable "eyeball lights" found in e.g., airplanes, automobiles, and home ceilings. In addition, range hood 115 can be equipped with more than four temperature sensors 120 (e.g., 5, 6 or 8) so that hood 115 can accommodate a cook top 100 having more than four heating elements 105. To the extent any sensors 120 are not needed, such could be disabled during installation by e.g., a variety of means including, but not limited to, an "Enable/Disable" switch or button, an IR-blocking lens cover, removal of the sensor, or any combination thereof.

Alternatively, temperature sensor 120 may be used to sense the temperature of a utensil (e.g., pot or pan) placed on the heating element or the temperature of food (including solids and/or liquids) located in the utensil. In the case of food, for example, temperature sensor 120 may be focused on a particular portion of food such as e.g., the center of a portion of food placed on heating element 105 or may include a large area of food surface such that temperature information across such area is provided rather than the temperature at a particular point.

By way of additional example, temperature sensors 120 may be adjustable so that the coverage area can be varied from e.g., a small spot at the center of the heating element 105 to a large spot that encompasses the entire heating element 105. Similar to a camera "zoom lens," one exemplary embodiment could be a "zoom ring" around the lens of the sensor 120, wherein twisting/turning/pulling on the ring would adjust the field of view of the sensor 120. In an alternative implementation, this adjustment of field of view could be made by motorized means (a motor driven lens) wherein the zoom-in/zoom-out control is provided by means of a knob or buttons on the control panel of the range hood.

In still another alternative, each temperature sensor 120 may be used to sense temperature(s) associated with an area on cook top 100 rather than a particular point. For example, temperature sensor 120 can be configured to sense or scan the temperature of all, or substantially all, of the exposed surface of food being cooked on one of the heating elements 105. The resulting scan can be used to determine an average temperature, for example.

In still another alternative, each temperature sensor 120 may be equipped with a light beam emitter, e.g. a laser pointer, to assist in the aiming of the sensor during installation. For example, during installation, the laser pointer feature of the sensor could be activated so that the 'eyeball' of the sensor could be manipulated such that the laser's spot can be directed to the center of the heating element to be monitored by the sensor. As an adjunct to the previously described implementation wherein the sensing area can be adjusted using a "zoom" control, the spot size of the laser pointer could also change in proportion to the zoom control so as to provide a realistic indication to the installer which area is being monitored by the sensor.

Figure 2:
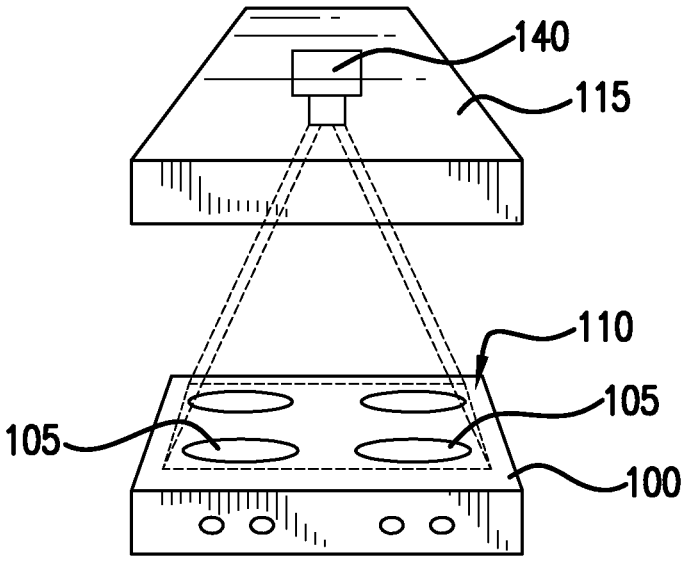
FIG. 2 is an illustration of another exemplary embodiment of the present invention using a single temperature sensor wherein the temperature sensor is a thermal image sensor capable of capturing the entire cook top surface therebelow with enough resolution to allow the control system to distinguish individual heating elements.

FIG. 2 provides another exemplary embodiment of the present invention in which range hood 115 is provided with a single temperature sensor 140. For example, temperature sensor 140 may be constructed from an infrared sensor, e.g. a thermal imaging sensor, that scans the entire surface 110 of cook top 100 and provides temperature information to a controller or processor configured with range hood 115. Such an IR sensor is similar to e.g., a video image sensor (e.g. CCD, etc), wherein a large number of picture elements (pixels), arranged in a grid, provide temperature information at a large number of locations across the cook top surface 110. Accordingly, temperature information across the entire surface 110 is collected and can be evaluated by the processor. Thus, the exemplary embodiment of FIG. 2 readily allows range hood 115 to be provided with a variety of different configurations for cook top 100 including, for example, heating elements of different quantities, sizes, shapes, and locations about surface 110. The key advantage of this embodiment is that the range hood system can automatically accommodate a cook top with any size/arrangement of heating elements, but also detect the temperatures of items placed on the cook top surface at positions removed from/adjacent to the actual heating elements.

As stated, a processor or processing device, such as a microprocessor, electronic module, or other electronic controller, can be used to evaluate the temperature information collected by one or more temperature sensors 120 and 140 and/or take certain steps in response to such temperature information as will be discussed below. Preferably, the processor is positioned within or otherwise associated with range hood 115. As such, the processor may be hidden from view of the operator and protected within an enclosure of range hood 115. Other locations for the processor may also be used. Multiple processors may be used to perform different steps as well—such as e.g., one processor for treating the information received from sensors 120 and another processor for executing an algorithm and/or taking certain actions based upon the temperature information.

Figure 3:
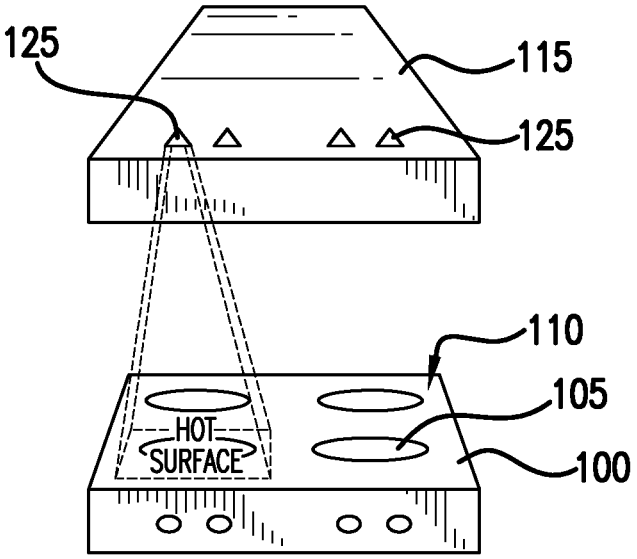
FIG. 3 provides as illustration of an exemplary embodiment of the present invention in which a range hood provides each heating element with an individual warning illumination in the form of an image/text projection system.

Range hood 115 can be provided with a variety of features for use of the temperature information provided by the one or more temperature sensors 120 and 140. Referring now to FIG. 3, for this exemplary embodiment range hood 115 includes a plurality of illumination warning devices 125, one positioned approximately above each heating element 105. For this exemplary embodiment, each illumination warning device 125 is configured to provide a visual warning or illumination that is projected over a respective heating element 105. For example, in the event a temperature sensor 120 or 140 over a given heating element 105 determines that an undesirable temperature level has been reached, then the controller can instruct illumination warning device 125 to project the words e.g. "HOT SURFACE" onto the heating element 105 or in close proximity thereto. Of course, other words or graphical symbols/icons may be used as well. Alternatively, illumination warning device 125 could be configured to illuminate heating element 105 with a particular color of light, such as e.g., red, to provide a visual notification to the user of an undesirable temperature condition. Alternatively, illumination warning device 125 could be configured to illuminate heating element 105 in a flashing/pulsating/blinking manner, with the rate of pulsation providing an indication of relative temperature. By way of example, the range hood 115 of FIG. 3 could be equipped with the temperature sensor configuration of either FIG. 1 or 2. By way of example, the illumination warning device 125 of FIG. 3 and the temperature sensing device 120 of FIG. 1 could be combined into a single unit, contained within the user-adjustable "eyeball."

Figure 4:
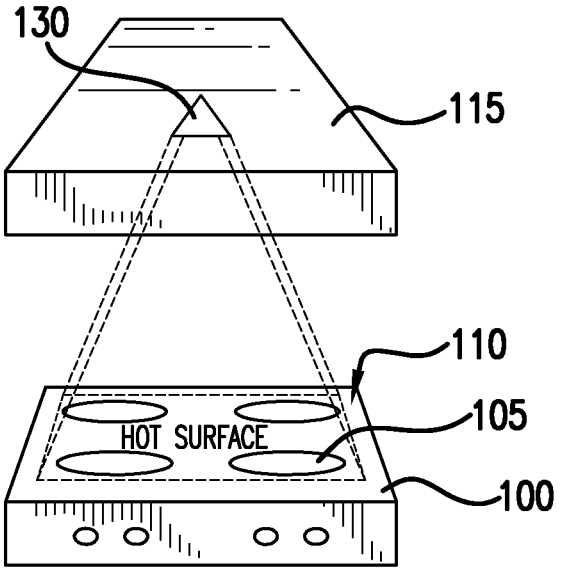
FIG. 4 provides an illustration of another exemplary embodiment of the present invention in which a range hood provides a single warning illumination for the entire cook top.

FIG. 4 provides another exemplary embodiment of a range hood having a single illumination warning device 130. For this exemplary embodiment, illumination warning device 130 is configured to provide a visual warning that is projected over the cook top 100 but is not necessarily associated with any particular heating element 105. For example, the words "HOT SURFACE" or some other visual indication could be provided anywhere on cook top 100 once an undesirable temperature condition has been reached at one or more of the heating elements as determined by one or more temperature sensors in range hood 115. Preferably, the visual warning or alert is centered on cook top surface 110 but other locations may be used as well. Alternatively, the illumination warning device 130 could be constructed as an image projector with a large number of pixels, wherein warning messages specific to each heating element could be projected individually; this would give the same visual result as shown in FIG. 3, however, the image(s) emanate from a single source. By way of example, the range hood 115 of FIG. 3 could be equipped with the temperature sensor configuration of either FIG. 1 or 2. By way of example, the illumination warning device 130 of FIG. 4 and the temperature sensing device 140 of FIG. 2 could be combined into a single unit.

Illuminating warning, devices 125 and 130 could be formed from a variety of constructions capable of projecting a notification onto cook top 100. For example, a bright light source such as halogen or multiple LEDs could be used with appropriate optics to project the image onto the cook top surface below. Alternatively, a laser could also be configured to provide such notification. Other constructions may be used as well, such as a picture/video image projector. It should also be understood that the visual indication warning could be projected onto a surface other than the cook top such as e.g., a kitchen counter or a wall near the cook top. The visual notification could also be provided as a light or other visual indicator that appears on or at a visible location on the range hood such as e.g., the shroud.

The exemplary embodiments of FIGS. 3 and 4 were described with warning devices 125 and 130 that provided a visual notification to a user of the appliance. Alternatively, or in addition thereto, these embodiments could be provided with audible warning devices such as an alarm or buzzer. As such, once a temperature sensor provides a temperature measurement indicating that one or more heating elements have reached an undesirable temperature level, an audible notification can be provided to a user of the appliance. Also, additional remedial responses may also be undertaken in addition to providing the user with a visual and/or audible alert. For example, range hood 115 could also be configured to activate a fan, turn on a lamp, or take other responses once a certain temperature level on cook top 100 has been measured. For example, range hood 115 could be equipped with an output signal capable of controlling a relay or other power control device which could be wired between the cook top appliance and the household power supply so that the range hood can disable (turn off) the cook top under certain conditions, e.g. approaching cooking oil ignition temperature, cook top inadvertently left on too long, etc. In addition to various audible and/or visual warnings, range hood 115 could also be equipped to send a text message or email to the user's home computer or cell phone.

Also, for each of the embodiments previously described, the predetermined temperature level at which one or more warning devices is activated can be selected from multiple different temperature events. For example, the predetermined temperature level could be a temperature at which it would be undesirable for a user to contact the heating element or surface being measured, a temperature at which there is a risk of igniting a cooking oil, a temperature at which food is likely to be burned, a temperature at which damage to the cook top is possible, and other temperature events as well.

A variety of methods may be employed for the operation of a range hood of the present invention using the temperature sensor configurations and warning devices previously described. As will be understood of by one of skill in the art using the teachings disclosed herein, one or more processing devices can configured, for example, to operate the range hood according to such methods. Also, different warnings or notifications may be employed for different temperature events.

For example, in one exemplary aspect of the present invention, range hood 115 can be configured to provide a first notification at a first predetermined temperature level TL1 and a second notification at a second predetermined temperature level TL2. $T_{L1}$ could be a temperature that might be considered "hot" to a user of the appliance such as e.g., about 140° F., while $T_{L2}$ could be a temperature above which cooking oil could be ignited (about 620° F. for certain canola oil types) such as e.g., 600° F. Alternatively, TL1 and TL2 could be set somewhat lower to provide a larger "cushion" or temperature interval between the time of the warning to the user and the higher temperature event. For example, about 120° F. could be used for TL1 and 550° F. for TL2. Regardless, multiple different predetermined temperature levels could be used so that warnings are provided to the user upon the cook top temperature(s), as measured by one or more temperature sensors in range hood 115, reaching one or more of such predetermined levels.

Additionally, different warnings may be provided that are indicative of which predetermined temperature level has been reached. For example, once a temperature sensor determines that a cook top temperature has reached or exceeded the first predetermined temperature $T_{L1}$, the words "HOT SURFACE" could be projected onto the cook top. Upon reaching the second predetermined temperature $T_{L2}$, the words "EXTREMELY HOT SURFACE" could be projected onto the cook top surface. Other words or alphanumeric designations could be used. Similarly, different audible signals could also be used for the different predetermined temperatures levels $T_{L1}$ and $T_{L2}$. Using the teachings disclosed herein, one of skill in the art will understand that multiple predetermined temperature levels $T_{Ln}$ may be employed as well such that warnings or notifications are provided for a variety of temperature events For certain embodiments of the invention, a time delay can be provided between measuring or sensing a certain temperature level on the cook top and providing the user with a warning or other notification. For example, if a user temporarily removes a cooking utensil from a heating element 105 and leaves such heating element activated, these actions could cause the temperature as measured by the temperature sensor to spike and generate an unwanted warning. Accordingly, a time delay $\Delta t$ could be provided to allow an interval before a warning or other notification is provided to the user. For example, a delay of 30 seconds could be provided between the time at which the range hood 115 measures a temperature that exceeds a predetermined temperature level TLn and the time at which a warning device to alert the user is activated. During this time interval, if the measured temperature falls below the predetermined temperature level $T_{Ln}$, then the notification would be not given and the timer would be reset.

In addition, a different time delay could be provided for each predetermined temperature level. For example, a time interval $\Delta t_1$ could be associated with predetermined temperature level $T_{L1}$ and a time interval $\Delta t_2$ could be associated with predetermined temperature level $T_{L2}$. For example, a shorter time interval might be used where the measured temperature is in a range that is conducive to ignition (combustion) of cooking oil. The time interval $\Delta t_n$ could be a variable that is calculated based on the measured temperature such that e.g., shorter intervals are used at higher measured temperatures.

In still another exemplary aspect of the present invention, a time delay could be employed to provide notification of when the user has left a heating element on for a prolonged period of time through e.g., inadvertence. For example, upon a certain predetermined temperature level being measured on cook top 100, a time interval $\Delta t_n$ of two hours could be employed. Once such time interval $\Delta t_n$ has expired, an alert could be provided to the user that indicates that one or more heating elements on cook top 100 are still activated. Such time interval delay could be employed along with other time delays for multiple other temperature events.

Range hood 115 can also be equipped with other features as well. For example, hood 115 could include a smoke detector for determining whether a cooking oil is generating smoke indicative of having reached a condition at which ignition is likely or has already occurred. In such case, a warning device as previously described could be activated to provide a visual and/or audible alert to the user of such condition. Other remedial responses could also be employed such as activation of a fire suppression system, disconnecting electrical power to the appliance, closing a gas supply valve within or external to the appliance, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A range hood with a temperature monitoring system for a cook top, the cook top having at least one heat source positioned about a cook top surface, the range hood comprising:

a temperature sensor positioned above the cook top and configured for detecting the temperature of the heat source of the cook top, a cooking utensil on the heat source, a food in the utensil, or a combination thereof;

a warning device comprising:

an illumination warning device configured to provide a first notification comprising a visual warning to a user of the appliance if said temperature sensor detects a temperature over a first predetermined temperature level, $T_{L1}$, for a first predetermined time interval, Δt1, that is dependent upon the temperature detected by the temperature sensor, wherein said visual warning is projected onto the cook top at a rate of pulsation that is indicative of a relative temperature increase of the temperature detected by said temperature sensor over the predetermined temperature level, $T_{L1}$.

2. A range hood as in claim 1, wherein the visual warning comprises at least one alphanumeric or graphical symbol projected onto the cook top that is identified with the heat source having a temperature that has exceeded the first predetermined temperature level, TL1.

3. A range hood as in claim 1, wherein the visual warning is projected over the heat source that has exceeded the first predetermined temperature level, TL1.

4. A range hood as in claim 1, wherein said warning device comprises an audible alarm indicative of the heat source having a temperature that has exceeded the first predetermined temperature level, $T_{L1}$.

5. A range hood as in claim 1, wherein said warning device is further configured for providing a second notification to the user if said temperature sensor detects a temperature over a second predetermined temperature level, $T_{L2}$.

6. A range hood as in claim 5, wherein said warning device comprises an illumination warning device that projects a visual warning onto the cook top surface that is identified with the heat source having a temperature that has exceeded the second predetermined temperature level, $T_{L2}$.

7. A range hood as in claim 5, wherein said warning device comprises an audible alarm indicative of the heat source having a temperature that has exceeded the second predetermined temperature level, $T_{L2}$.

8. A range hood as in claim 5, wherein said warning device provides the second notification to the user if said temperature sensor detects a temperature over the second predetermined temperature level, $T_{L2}$, for a second predetermined time interval, $\Delta t_2$, that is dependent upon the temperature detected by the temperature sensor.

9. A range hood as in claim 1, wherein the cook top includes multiple heat sources, and wherein said temperature sensor comprises a plurality of temperature sensors with each associated to a respective heat source.

10. A range hood as in claim 1, wherein the cook top includes multiple heat sources, and wherein said temperature sensor is configured for providing temperature measurements indicative of the temperature associated with each of the heat sources.

11. A range hood as in claim 1, further comprising at least one processing device configured for receiving temperature measurements from said temperature sensor and providing instructions to said warning device based upon the temperature measurements.

12. A method of monitoring the temperature of a cook top, the cook top having at least one heat source, the method comprising the steps of:

sensing the temperature of the heat source, a cooking utensil on the heat source, a food in the utensil, or a combination thereof;

determining whether the temperature measured in said step of sensing exceeds a predetermined level for a predetermined time interval that is dependent upon the temperature measured in said step of sensing, and, if so, then providing a warning to a user of the cook top, wherein the warning is a visual notification that is projected onto the surface of the cook top at a rate of pulsation that is indicative of a relative temperature increase of the temperature measured in said step of sensing over the predetermined level.

13. A method of monitoring the temperature of a cook top, the cook top having at least one heat source, the method comprising the steps of:

using a temperature sensor positioned above the cook top to determine the temperature of the heat source, a cooking utensil on the heat source, a food in the utensil, or a combination thereof;

determining whether the temperature measured in said step of sensing exceeds a predetermined level for a predetermined time interval that is dependent upon the temperature measured in said step of sensing, and, if so, then providing a warning to a user of the cook top, wherein the warning is a visual notification that is projected onto the surface of the cook top at a rate of pulsation that is indicative of a relative temperature increase of the temperature measured in said step of sensing over the predetermined level.

14. A method for monitoring the temperature of a cook top as in claim 13, further comprising the steps of:

ascertaining whether the temperature measured in said step of sensing exceeds a second predetermined level $T_{L2}$, and, if so, then communicating a warning to a user of the cook top that is indicative of the temperature exceeding the second predetermined level, $T_{L2}$.

15. A method for monitoring the temperature of a cook top as in claim 14, wherein the warning of said step of communicating further comprises an audible alarm.

16. A method for monitoring the temperature of a cook top as in claim 15, further comprising the step of providing a second predetermined time interval, $\Delta t_2$, between said step of ascertaining and said step of communicating, wherein the second predetermined time interval $\Delta t_2$ is dependent upon the temperature measured in said step of sensing.

17. A method for monitoring the temperature of a cook top as in claim 16, wherein the second predetermined time interval $\Delta t_2$ is dependent upon the temperature measured in said step of sensing.

* * * * *